United States Patent [19]

Leuthold et al.

[11] Patent Number: 4,466,605

[45] Date of Patent: Aug. 21, 1984

[54] STACKING DEVICE FOR SHEET MATERIAL

[75] Inventors: Karl Leuthold, Munich; Wilhelm Mitzel, Neu-Keferloh; Markus Haberstroh, Landsberg, all of Fed. Rep. of Germany

[73] Assignee: GAO Gesellschaft für Automation und Organisation mbH, Fed. Rep. of Germany

[21] Appl. No.: 298,595

[22] Filed: Sep. 2, 1981

[30] Foreign Application Priority Data

Aug. 7, 1981 [DE] Fed. Rep. of Germany ..... 3131388

[51] Int. Cl.[3] ..... B65H 29/38; B65H 29/24; F01H 5/00

[52] U.S. Cl. ..... 271/177; 271/195; 271/196; 271/189; 181/211

[58] Field of Search ..... 271/195, 196, 194, 276, 271/177, 178, 184, 185, 186, 197, 188, 211; 414/106, 107, 108; 181/238, 268, 211

[56] References Cited

U.S. PATENT DOCUMENTS

| | | | |
|---|---|---|---|
| 2,759,543 | 8/1956 | Conti | 271/194 X |
| 4,027,580 | 6/1977 | Sundlin | 271/186 X |
| 4,073,487 | 2/1978 | Schirrmeister et al. | 271/196 X |
| 4,105,089 | 8/1978 | Judd | 181/268 X |
| 4,310,152 | 1/1982 | Mitzel | 271/195 X |

*Primary Examiner*—Bruce H. Stoner, Jr.
*Assistant Examiner*—Lisa M. Rosenberg
*Attorney, Agent, or Firm*—Andrus, Sceales, Starke & Sawall

[57] ABSTRACT

A stacking device for sheet material such as banknotes and receipts has a stacker drum with a suction opening at a predetermined location on the periphery. The suction opening grips the leading edges of the sheets to be stacked at a first tangential position and releases the sheets against a stopper at a second tangential position. The stacker drum has air openings on the periphery behind the suction opening. The air openings discharge pulsating compressed air to separate the portion of the sheets trailing the leading edges from the drum.

11 Claims, 11 Drawing Figures

17
6
16
9
5
29

6
17
16
9
5a
5
26
29

5
10
23
22
16
17
8
9
6
T
20
21
5a
27
26
25
29

STACKING DEVICE FOR SHEET MATERIAL

The invention relates to a stacker for flat sheet material such as banknotes, receipts, and so on, having a stacker drum which rotates vertically on a base plate, catches the sheet material at its leading edge by aid of suction openings, stacks it up at a stopper by its rotating motion and acts upon it with compressed air by means of blowing openings arranged behind the suction openings in the direction of rotation, in order to straighten it before stacking.

In the case of stackers of the above-mentioned type, a problem arises concerning the proper separation of the sheet material especially at high stacking speed. The sheets at the drum have a tendency to slide tangentially along the drum surface after the leading edge has met the stopper, which frequently results in the sheet folding approximately in the middle and being stacked up in this folded state.

It has already been proposed (DE-OS No. 25 55 306) as a solution to this problem to arrange a blast nozzle on the stacker drum which emits a directed stream of air onto the drum tangentially in the direction of rotation. When the trailing portion of the sheet taken up by the stacker drum goes past the blast nozzle, air should come between the sheet material and the drum and thereby separate the sheet from the drum surface. For the proper functioning of this solution it is necessary that the trailing portion of the sheet first be separated from the drum independently, so that the air blast can then take effect. This is often not the case, so that the stream of air even supports the folding of the sheet material along its center line.

Better stacking quality can be achieved if, as proposed in the U.S. Pat. No. 2,759,543, the air blast takes effect from the inside of the drum through isolated blowing openings. The blowing openings are situated behind the suction openings, when seen in the direction of rotation, which suction openings hold the leading edge of the sheet.

But even with this last-mentioned stacker no satisfactory results can be obtained. It has turned out that the sheet material in many cases sticks to the drum surface too long, especially at the end of the sheet, in spite of the air blast, when the sheet material is in a very flaccid state, as in the case of used banknotes. The sheets are prevented from systematically straightening out again.

The object of the invention is to provide a stacker of the above-mentioned type which allows for the proper separation from the drum and the subsequent straightening out.

The stacking device for sheet material of the present invention has a stacker drum with a suction opening at a predetermined location on the periphery for gripping the leading edges of the sheets to be stacked at a first tangential position coupled to a sheet transport system and releasing the sheets against a stopper at a second tangential position. The stacker drum has air openings on the periphery behind the suction opening. The air openings discharge pulsating compressed air to separate the portion of the sheets trailing the leading edges from the drum.

In the case of a stacker according to the invention the trailing portion of the sheet is separated much more easily and thus more quickly from the drum surface, so that the sheet can straighten out again during the rotation of the drum without any obstruction. The considerable improvement in stacking quality caused by the orderly straightening of the notes is essentially due to the fact that in the construction of compressed air channels and suction openings according to the invention the air blast does not act on the sheet material continuously, but rather intermittently or pulsatingly.

It has been shown in fact that the trailing portion of the sheet material is not repulsed from the drum surface, but rather sucked onto it, by a continuous blast of air under certain conditions due to the "Bernoulli Effect" known in fluid dynamics.

In the constructive solution according to the invention all compressed air channels are clear and thus all blowing openings are active at a certain angular position of the drum, while at a second angular position all compressed air channels are closed. In this form of execution the level of the air blast varies between a maximal value and zero value.

According to another form of execution of the invention, the blowing openings of the rotor are assigned to the compressed air channels of the stator in such a way that there is no angular position of the drum in which all compressed air channels are completely open or completely closed. In this arrangement, which is characterized among other things by reduced running noise relative to the above-mentioned arrangement, the level of the air blast varies between a maximal value and a basic level greater than zero.

Furthermore, both forms of execution of the invention have the advantage that the rate of air flow is considerably reduced.

According to an advantageous development of the invention blast nozzles are provided additionally outside the stacker drum. These blast nozzles counteract the fanwise spread of the stacked notes.

Details of the invention, further advantages and developments are explained in the following with reference to the figures.

Figures 3A, 3B, 3C:
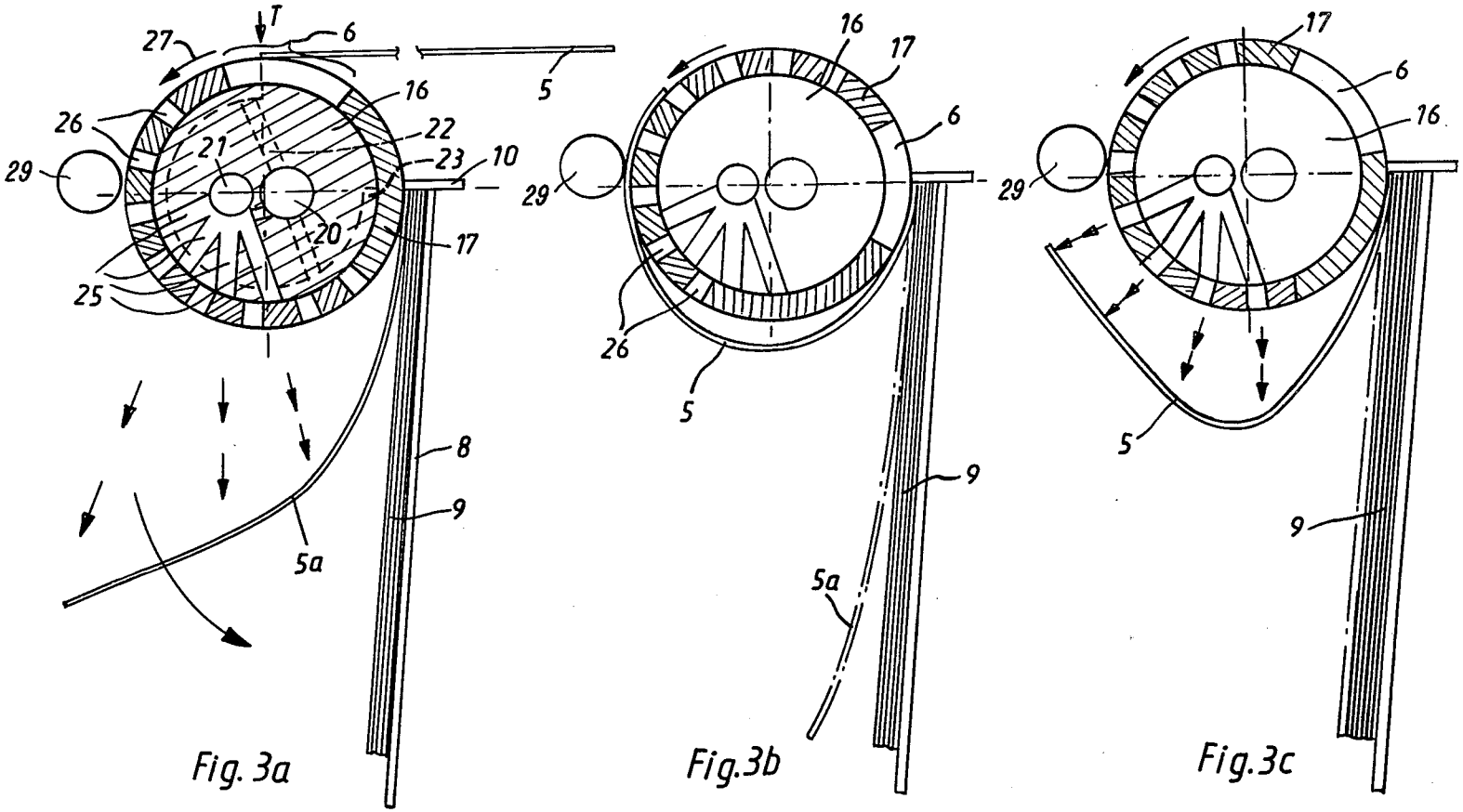
Figure 4A:
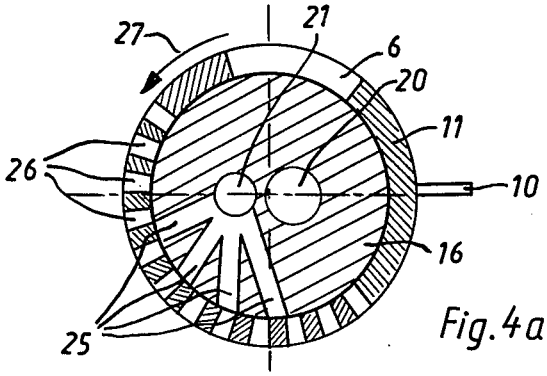
Figure 4B:
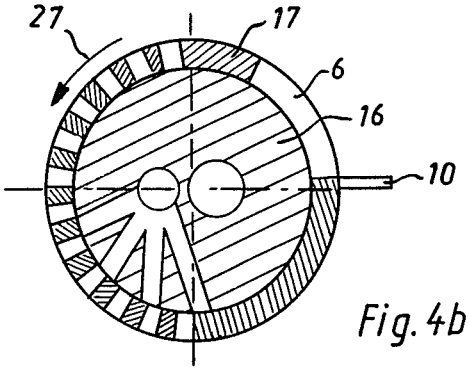
Figure 4C:
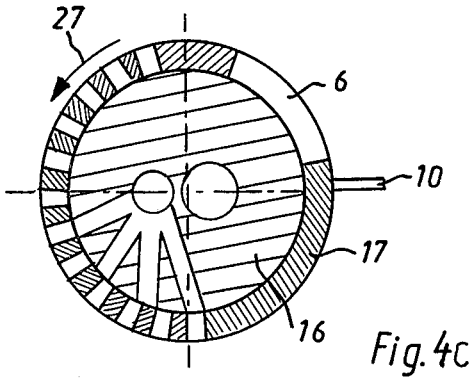
Figure 5:
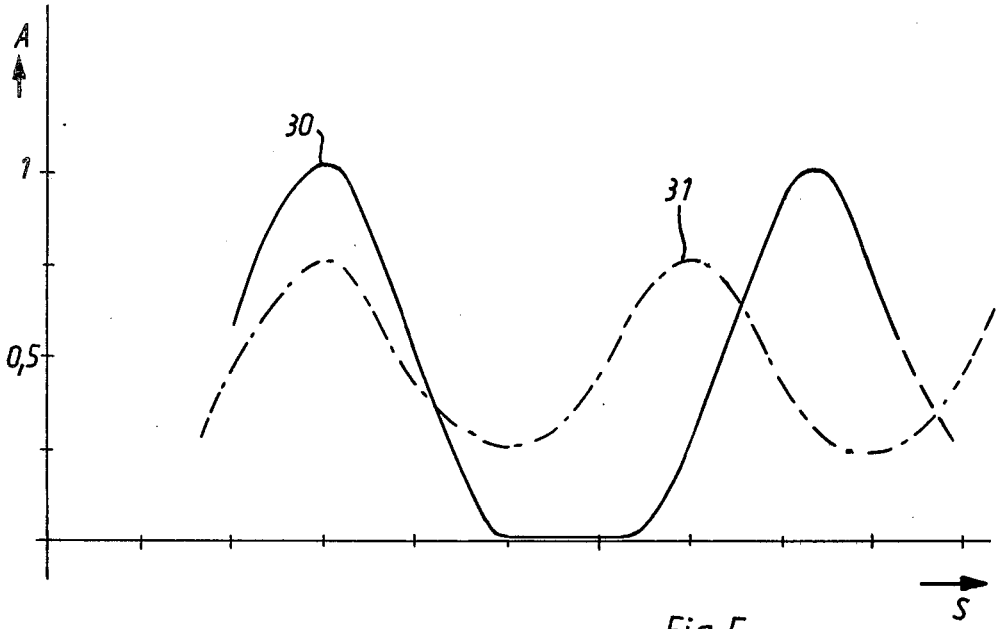
Figure 6:
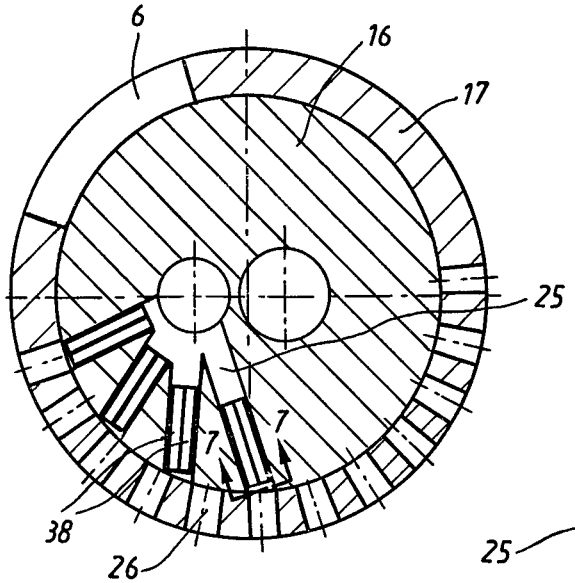
Figure 7:
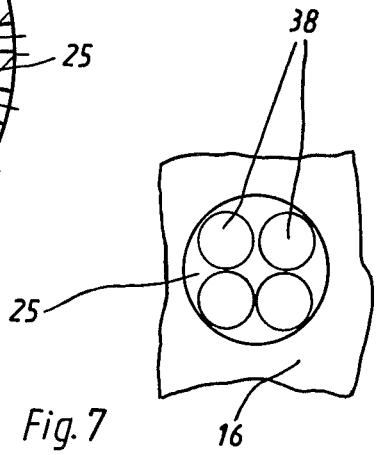

FIGS. 3*a*, 3*b* and 3*c* show the constructional arrangement of the stacker drum in three operational phases, FIGS. 4*a*, 4*b* and 4*c* show a further form of execution of the stacker drum, FIG. 5 shows traces of curves of the intensity of the air blast as a function of the rotor position, FIG. 6 shows a stacker drum of which the stator channels have pipe insets, and FIG. 7 shows the detail drawing of a stator channel, taken along Line 7—7 of FIG. 6.

Figure 1:
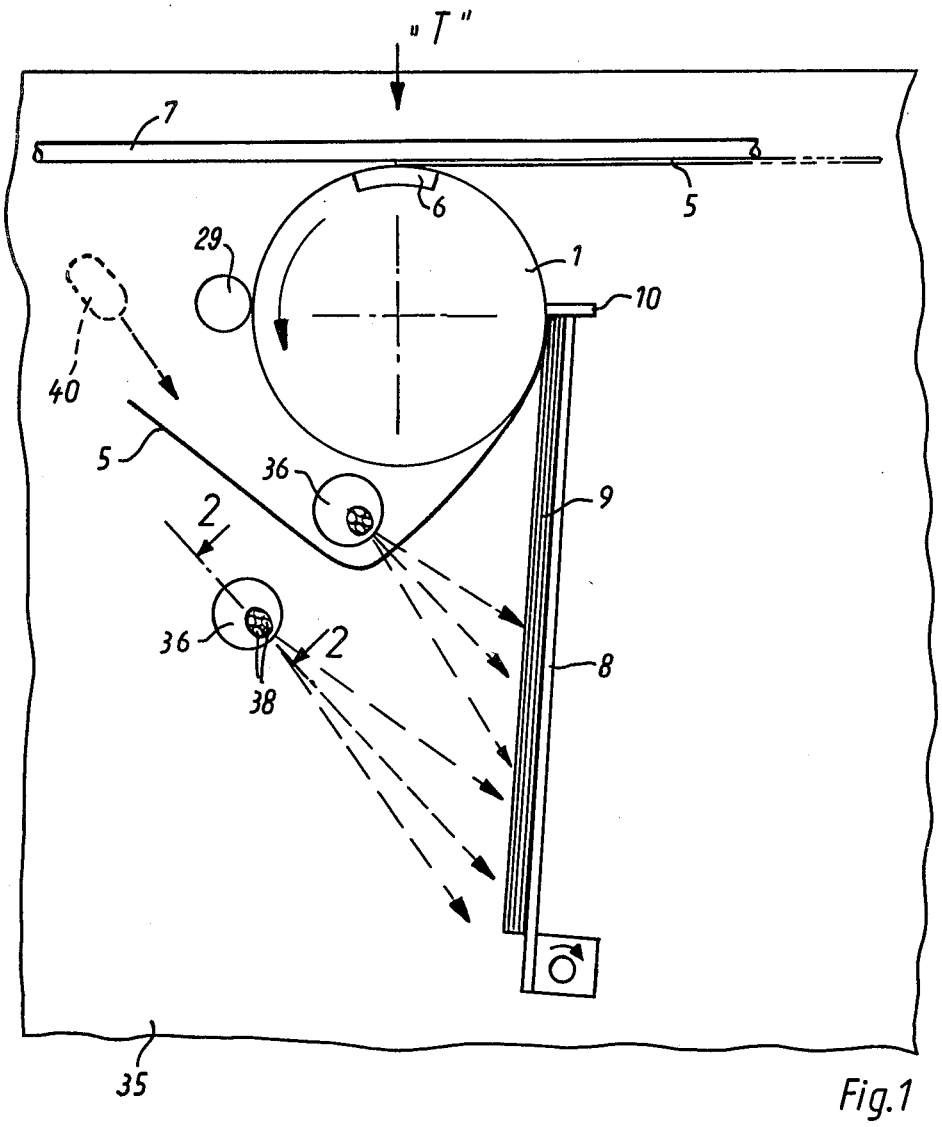
FIG. 1 shows the construction of a stacker, greatly simplified.

FIG. 1 shows a stacker as used, for example, in equipment for the automatic sorting of banknotes. The stacker, being the terminal member of the equipment, has the task of stacking banknotes of a certain category, e.g. soiled notes. The notes 5 are directed to the stacker drum 1 by means of the transport system 7 shown graphically in the figure. The time interval between the arriving notes is set in such a way when the drum 1 rotates constantly that the leading edge of each banknote meets the suction area 6 of the stacker drum 1 at the point of contact between the transport system and the drum (tangential point "T"). When the note is caught it is directed by the rotation of the drum against the stopper 10 and thereby deposited on the stack 9, if there is one, or on the stack plate 8. The plate is mounted on a pivot and thus adapts itself automatically to the stack as it increases. Details of this stacking principle are described, for example, in the DE-OS No. 29 09 833. In order to form an orderly stack it is necessary that the middle or trailing portion of the banknote, respectively, is separated from the stacker drum in time and that it is straightened out again, so that it can finally lie against the stacking plate with its entire surface. These conditions are met by the stacker according to the invention, which is shown in an exemplary embodiment in FIGS. 3*a* to 3*c* in three consecutive operational phases.

The stacker drum consisting of a stator 16 and a rotor 17 contains a vacuum system and an air blast system. The vacuum system is only of marginal interest here. It is shown graphically in FIG. 3*a* with the vertical bore 20, which is connected to a vacuum pump not shown in the figures, the connecting channels 22 and the suction channel 23. The suction channel extends approximately from tangential point "T" to the stripper 10. In this area the suction openings 6 provided in the rotor are connected with the vacuum pump. Details of the vacuum system are described in the DE-PS No. 28 56 777.

Beside the bore 20 for the vacuum a second bore 21 is arranged in the stator 16 which is connected with an air blast source not shown in the drawing. In this embodiment four stator channels 25 are connected with the bore 21, which channels lead to the surface of the stator branched radially. Blowing openings 26 adjusted in their diameter to the channels 25 are provided in the rotor 17 generally as a continuation of these stator channels 25. The openings are arranged along a circumferential line of the rotor and extend over an area which begins approximately 80° to 100° behind the suction area 6 in the direction of rotation of the drum (arrow 27) and ends approximately 15° to 30° before the suction area. In addition, it is advisable to provide several rows of blowing openings with the appropriate stator channels interconnected, i.e. perpendicular to the intermediate level (referring to the figures), in order to be able to influence the entire width of the note that is to be stacked.

In the embodiment shown in FIGS. 3*a* to 3*c* the position of the stator channels 25 is selected relative to the position of the blowing openings 26 along a circumferential line of the rotor 17 in such a way that all stator channels are closed when the rotor is in a certain position and all stator channels are completely open when the rotor is in another position.

The intensity pattern of the air blast as a function of the position of the rotor is shown qualitatively in the series of curves 30 in FIG. 5. The intermittent characteristic of the signal, which varies between a maximal value and zero value, ensures that the banknote is quickly separated from the stacker drum.

The straightening process is shown in FIGS. 3*a* to 3*c*.

FIG. 3*a* shows the situation in which the suction area 6 of the rotor 17 is at tangential point "T" to take up a banknote 5. The banknote 5*a* that was taken up previously and has been directed against the stopper 10 is now in the straightening process and is moving towards the banknote stack 9 at the stack plate.

FIG. 3*b* shows the situation immediately after the leading edge of the banknote 5 taken up in FIG. 3*a* has reached the stopper 10. The trailing portion of the note is transported further in spite of the fact that the leading edge has been rolled on, since the trailing portion is held in frictional engagement between the rotor 17 and a pressure pulley 29. Meanwhile the first blowing openings 26 have reached the stator area in which the stator channels are situated.

In the representation in FIG. 3*c* the trailing edge of the banknote has left the jam between the pressure pulley 29 and the rotor 17. In this operational phase the banknote is acted upon by an intermittent air blast in the rear area as well as in the central area. Thus particularly the rear area of the banknote separates quickly from the drum surface after leaving the jam and can straighten out without hindrance (see FIGS. 3*a*, 3*b* banknote 5*a*).

FIGS. 4*a* to 4*c* show a further embodiment of the invention. The stacker drum 17 is shown once again in three operational phases corresponding to those shown in FIGS. 3*a* to 3*c*. The construction of the stator 16 with its arrangement of stator channels 25 remains unchanged. However, in this embodiment considerably more blowing openings are provided in the rotor 17 at approximately the same circumferential length. The interval between the blowing openings 26 is thus approximately as large as their diameter. As can be seen in the Fig. there is no rotor position for this stacker drum in which *all* stator channels 25 are completely closed. There is not any rotor position in which all stator channels 25 are completely open, either.

The intensity pattern of the air blast resulting from this arrangement is shown by the dotted series of curves 31 in FIG. 5. The intermittent signal is compressed in its dynamic range relative to the signal 30 and has a higher frequency.

An advantage of this latter embodiment is that the operational noise caused by the stacker drum is considerably reduced without reducing the stacking quality.

Two stacker drum arrangements have been discussed above. It is clear from what has been said up to now that the traces of the curves shown in FIG. 5 can practically be varied at will by the number, position and size of the stator channels and the blowing openings in the drum. The optimum is attained when the intermittent character of the signal is effective enough that the banknote straightens out quickly and over its entire surface without sticking to the drum and when the operational noise and the rate of air flow are minimized.

When long and very ragged notes, i.e. notes with extremely little inherent rigidity, are stacked, it may come about that they are deposited on the stacking plate spread out more or less like a fan. This fanwise spreading which can be a hindrance when the stack is removed from the apparatus is avoided or greatly reduced when ground nozzles 36 are inserted into the base plate 35 on which the stacker drum 1 rotates, as shown in FIGS. 1 and 2.

The ground nozzles are constructed and mounted in the base plate 35 in such a way that they emit a stream of air obliquely from the base plate against the rear end of the stack 9 and thus press the notes against the stacking plate. The ground nozzles are on a level with the surface of the base plate in order not to impede the straightening of the banknotes. They take effect when the banknote 5 has emerged and is moving towards the stacking plate 8 straightened out.

The ground nozzles shown in FIG. 1 can also be replaced by one blast nozzle 40 (suggested by a dotted line in the Fig.), arranged outside the straightening area of the banknote. A negative influence on the straightening process of the banknote is avoided by a strong concentration of the air blast with its main component directed towards the rear area of the stack, and a component of the air blast as slight as possible tangentially along the stacker drum.

Figure 2:
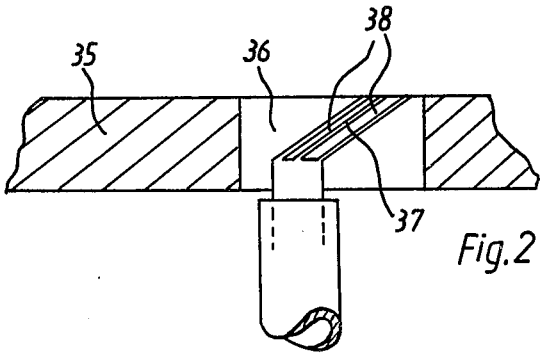
FIG. 2 shows the construction of a ground nozzle used in the base plate.

As shown in FIGS. 1 and 2, the bores 37 of the ground nozzles 36 are provided with several pipes 38 arranged close together. These pipes, which have a cross-section considerably reduced relative to the bore, have a double effect, as has been shown. The unidirectional effect of the blast nozzles is intensified. The blowing noise is reduced. Several pipes 38 are arranged in the stator channels 25 as well for these reasons, as shown in FIGS. 6 and 7. As the effective length of the pipes intensifies their advantageous properties, they are preferably arranged in the stator channels 25 and not in the blowing openings 26 of the rotor, which are considerably shorter than the stator channels.

What is claimed is:

1. A stacking device for flat material sheets comprising: a rotatable stacker drum for tangentially receiving sheets of material from a sheet transport system at a first tangential position and arcuately moving the sheets to a stop at a second tangential position at which a stack is formed; suction supply means having at least one suction opening at a predetermined location on the periphery of said stacker drum for gripping the leading edges of the sheets at said first tangential position and releasing said sheets at said second tangential position; and compressed air supply means including air openings on the periphery of said stacker drum for discharging intermittent blasts of compressed air from said air openings, each of said blasts having a plurality of pulsations alternately increasing and decreasing in magnitude, said air openings being positioned behind said suction opening in the direction of rotation of said stacker drum for applying the pulsating air blasts to the sheets to separate the portions of the sheets trailing the leading edges from the drum.

2. A stacking device as in claim 1 wherein said compressed air supply means is further defined as means for discharging intermittent blasts of compressed air in which the peak magnitude of the pulsations changes as said drum rotates.

3. A stacking device as in claim 1 wherein said compressed air supply means includes a stator about which said stacker drum rotates, said stator having a plurality of spaced, compressed air channels, and wherein said air openings on said stacker drum are coupleable with the compressed air channels in the stator as the stacker drum rotates.

4. A stacking device as in claim 3 wherein the channels in said stator and air openings in said drum are so arranged that said air openings are completely coupled with said channels when said stacker drum is in one rotary position and said channels are completely decoupled with said air openings when said stacker drum is in another rotary position.

5. A stacking device as in claim 3 wherein said channels and air openings are arranged such that a majority of said air openings are coupled to said channels when said drum is in one rotary position and a majority of said air openings are decoupled from said channels when said drum is in another rotary position.

6. A stacking device as in claim 3 wherein said stator channels are distributed over an arc of approximately 90° and end approximately 90° before the stop.

7. A stacking device as in claim 1 wherein said air openings occupy a predetermined portion of the periphery of said stacker drum.

8. A stacking device as in claim 7 wherein said air openings begin approximately 80° to 100° behind said suction opening in the direction of rotation of said stacker drum and end approximately 15° to 30° before said suction opening.

9. A stacking device as in claim 3 wherein said stacking drum and stator have cylindrical exterior surfaces and said drum rotates about an axis located in said stator, and wherein said stator channels and air openings are arranged in rows across the exterior surfaces of the stator and drum parallel to the axis in the stator.

10. A stacking device as in claim 3 wherein said stator channels include a plurality of pipes lying within the channels and aligned therewith.

11. A stacking device as in claim 1 wherein said stacker drum extends above a base plate and wherein at a position in which the sheets have been separated from the drum, at least one blast nozzle is arranged in the base plate for obliquely discharging air against the trailing edges of the stack of sheets formed at said stop.

* * * * *